United States Patent [19]

Yao

[11] Patent Number: 4,846,962

[45] Date of Patent: Jul. 11, 1989

[54] REMOVAL OF BASIC NITROGEN COMPOUNDS FROM EXTRACTED OILS BY USE OF ACIDIC POLAR ADSORBENTS AND THE REGENERATION OF SAID ADSORBENTS

[75] Inventor: Keith C. Yao, Sarnia, Canada

[73] Assignee: Exxon Research and Engineering Company, Florham Park, N.J.

[21] Appl. No.: 14,271

[22] Filed: Feb. 12, 1987

[51] Int. Cl.[4] ..... C10G 25/00; C10G 34/00

[52] U.S. Cl. ..... 208/301; 208/14; 208/254 H; 208/299; 208/305

[58] Field of Search ..... 208/299, 301, 305, 254, 208/14

[56] References Cited

U.S. PATENT DOCUMENTS

| | | | |
|---|---|---|---|
| 1,997,938 | 4/1935 | Loomes | 208/301 |
| 2,195,659 | 4/1940 | Shoemaker | 208/14 |
| 2,273,846 | 2/1942 | Dunmere | 208/299 |
| 2,316,005 | 4/1943 | Lachle | 208/305 |
| 2,352,064 | 6/1944 | Zerbe | 208/305 |
| 2,375,696 | 5/1945 | Strickland | 208/305 |
| 2,384,315 | 9/1945 | Kuhl | 208/91 |
| 2,647,858 | 8/1953 | Weisz | 196/44 |
| 2,708,519 | 5/1955 | Novak | 208/305 |
| 2,744,053 | 5/1956 | Kay et al. | 196/28 |
| 2,769,751 | 11/1956 | Paull | 196/14 |
| 2,908,639 | 10/1959 | Carter et al. | 208/310 |
| 2,919,251 | 12/1959 | Shuman | 252/414 |
| 2,926,135 | 2/1960 | Engel et al. | 208/299 |
| 2,949,421 | 8/1960 | Mills | 208/299 |
| 2,951,036 | 8/1960 | Bodkin | 208/305 |
| 2,954,338 | 9/1960 | Carmody | 208/299 |
| 2,984,620 | 5/1961 | Fleck et al. | 208/305 |
| 3,189,539 | 6/1965 | Sieg | 208/254 |
| 3,201,344 | 8/1965 | Broughton | 208/301 |
| 3,224,955 | 12/1965 | Anderson | 208/301 |
| 3,238,123 | 3/1966 | Vourhies et al. | 208/264 |
| 3,239,455 | 3/1966 | Lickus | 208/301 |
| 3,243,366 | 3/1966 | Kimberlin et al. | 208/26 |
| 3,331,770 | 7/1967 | Cockerham | 208/301 |
| 3,462,358 | 8/1969 | Mills et al. | 208/301 |
| 3,551,324 | 12/1970 | Lillard | 208/14 |
| 3,654,128 | 4/1972 | Woodle | 208/33 |
| 3,705,850 | 12/1972 | Wolk | 208/127 |

(List continued on next page.)

FOREIGN PATENT DOCUMENTS

| | | | |
|---|---|---|---|
| 995437 | 8/1976 | Canada | 23/366 |

OTHER PUBLICATIONS

"Removal of Nitrogen Compounds From Lubricating Oils", Ind. Eng. Chem., Prod. Res. Dev. 22 (2), pp. 276–279, Jun. 1983.

"Silicalite, a new hydrophobic crystalline silica molecular sieve" Flanigen et al., Nature, vol. 271, 9, Feb. 1978, pp. 512–516.

*Primary Examiner*—H. M. Sneed
*Assistant Examiner*—Helane Myers
*Attorney, Agent, or Firm*—Joseph J. Allocca

[57] ABSTRACT

Basic nitrogen compounds (BNC) are selectively removed from solvent extracted oils by adsorption of said BNC's by solid acidic polar adsorbents. The oils are extracted using any of the common extraction solvents, such as furfural, phenol, $SO_2$, N-methyl-2-pyrrolidone (NMP), preferably NMP. The resulting raffinate, which contains the desirable oil fraction, has the BNC's present therein removed by adsorption thereof onto an adsorbent, characterized as being a solid, polar acidic adsorbent, exemplified by silica-alumina, a high alumina base amorphous cracking catalyst (such as manufactured by Ketjen/Akzo) and crystalline zeolite (such as H-Y zeolites) are effective adsorbents. The adsorbents may additionally contain fluorine or may contain up to 30 weight percent water. The adsorbents are regenerated by either purging with hydrogen at elevated temperature and pressure, or by washing the BNC saturated adsorbent with extraction process extraction solvent, such as NMP.

Extracted oil raffinate treated with the adsorbent to remove BNC exhibit superior uninhibited oxidation stability as compared to untreated conventional hydrofined oil.

18 Claims, 9 Drawing Sheets

U.S. PATENT DOCUMENTS

| | | | |
|---|---|---|---|
| 3,732,154 | 5/1973 | Mills et al. | 208/14 |
| 3,755,152 | 8/1973 | Gulick | 208/307 |
| 3,830,730 | 8/1974 | Meud et al. | 208/87 |
| 3,849,298 | 11/1974 | Funakubo et al. | 208/310 |
| 3,901,792 | 8/1975 | Wolk | 208/210 |
| 3,920,540 | 11/1975 | McCoy et al. | 208/299 |
| 3,922,217 | 11/1975 | Cohen et al. | 205/299 |
| 3,926,783 | 12/1975 | Wolk | 208/157 |
| 4,008,148 | 2/1977 | Masshugu et al. | 208/14 |
| 4,081,352 | 3/1978 | West et al. | 208/36 |
| 4,090,951 | 5/1978 | Smith | 208/91 |
| 4,110,196 | 8/1978 | Bosniaek et al. | 208/14 |
| 4,120,782 | 10/1978 | Aucleh et al. | 208/305 |
| 4,137,154 | 1/1979 | Audeh | 208/254 |
| 4,152,249 | 5/1979 | Arvillon et al. | 208/299 |
| 4,269,694 | 5/1981 | Holland et al. | 208/299 |
| 4,404,118 | 9/1983 | Herskovits | 200/305 |
| 4,419,219 | 12/1983 | Long et al. | 208/86 |
| 4,422,926 | 12/1983 | Gould et al. | 208/86 |
| 4,423,278 | 12/1983 | Yang et al. | 585/823 |
| 4,424,114 | 1/1984 | Murrell et al. | 208/86 |
| 4,455,444 | 6/1984 | Kulprathipanja et al. | 585/826 |
| 4,469,805 | 9/1984 | Kotke, Jr. et al. | 208/305 |
| 4,487,688 | 12/1984 | Dessau | 208/310 |
| 4,622,130 | 11/1986 | Stem | 208/87 |

ADSORBENT TREATING NORTH SEA 150N 95 VI OIL FOR BN REMOVAL

NMP EXTRACTION/ADSORPTION FOR LUBES

OVERALL FLOW DIAGRAM OF PROCESS

EFFECT OF ADSORPTION PRESSURE ON BN REMOVAL

EFFECT OF REGENERATION TEMPERATURE ON PERFORMANCE OF KETJEN HA FOR BN REMOVAL

EFFECT OF PRE-HYDROFINING ON PERFORMANCE OF KETJEN HA FOR BN REMOVAL

REMOVAL OF BASIC NITROGEN COMPOUNDS FROM EXTRACTED OILS BY USE OF ACIDIC POLAR ADSORBENTS AND THE REGENERATION OF SAID ADSORBENTS

Polar basic nitrogen compounds (BNC) are identified in the art as the cause of, or at least contributors to the poor oxidation stability of solvent extracted, especially n-methyl-2-pyrrolidone (NMP) extracted oils, such as transformer oils. Uninhibited oxidation stability is quite low in such oils when the BNC's are removed by hydrofinishing since such hydrofinishing removes not only the nitrogen compounds, which are detrimental to oxidation, but also a significant portion of the sulfur compounds, which are also present in the oil and some of which are believed to contribute to the oxidation stability of the oil.

It would be a major benefit if a means could be identified for selectively removing BNC from solvent extracted oils, especially NMP extracted oils, particularly NMP extracted raffinates.

It is an object of the present invention to remove BNC's from solvent extracted oils, while leaving the beneficial sulfur compounds in the oils using solid polar acidic adsorbents.

It is also an object of the present invention to easily regenerate the BNC saturated solid polar acidic adsorbents for re-use.

THE PRESENT INVENTION

Solvent extracted oils, e.g., extracted lube or specialty oils (transformer or refrigeration oils), particularly NMP extracted raffinates, have their BNC levels reduced and their oxidation stability (especially their uninhibited oxidation stability) improved by contacting said solvent extracted oil with an adsorbent which selectively removes the BNC's from the extracted oils.

The adsorbents which are employed in the present invention are identified as solid acidic adsorbents containing between 20–30 weight percent alumina, preferably 20–25 weight percent alumina. Such adsorbents which satisfy the requirements of the present invention include silica-alumina and silica-alumina-magnesia-type materials. They can be crystalline (such as H-Y zeolite) or amorphous (such as Ketjen/Akzo amorphous silica-alumina cracking catalyst base) in nature. Amorphous adsorbents are generally preferred. The adsorbents should have sufficient surface area, porosity and acidity to adsorb effective amounts of basic nitrogen from extracted oils. Also, pore diameter of the adsorbent should be large enough to allow fast adsorption of oil molecules and effective regeneration of adsorbent.

It should be mentioned that the above characteristics are both important. One factor alone provides insufficient basis for adsorbent selection. For example, active carbon and silica gel have high surface area but low acidity, thus give poor capacity for BNC removal (see Table I). Generally, the surface area of a desirable adsorbent should be from 50–700 $m^2/g$ and preferably 100–500 $m^2/g$. The average pore diameter of amorphous adsorbents is usually from 10–200 Å and preferably 20–100 Å. Silica-to-alumina ratio, which can govern the adsorbent acidity, should be such that the alumina content of the material is between 20–30 weight percent, preferably 20–25 weight percent. This alumina content cannot be achieved simply by adding additional alumina to a material having an alumina content outside (i.e., lower than) the desired range, thereby producing a mixture having an alumina content of 20–30 weight percent. The alumina content of 20–30 weight percent must be that of the material itself, that is, of the amorphous silica-alumina adsorbents, such as Ketjen HA, or aluminosilicate (zeolites), such as H-Y zeolite. Deficiencies in alumina cannot be made up simply by adding additional free alumina.

Further, treatment of the acidic, high surface area adsorbent with water prior to utilization as a BNC adsorbent has been found to enhance adsorbent performance. Adsorbent containing up to about 30 weight percent water showed improved adsorption capacity as compared to dry adsorbent. Water content above 30 weight percent results in rapid deterioration of adsorption capacity. Water content is preferably between about 10 to 30 weight percent, more preferably between about 20 to 30 weight percent.

In addition, treatment of the adsorbent with a fluorinating agent, such as $NH_4F$, etc., has been found to greatly enhance adsorption capacity, yet the fluorine added to the adsorbent is not removed during the regeneration step, as compared to prior art treatment with, for example, HCl wherein although the presence of chlorine enhanced adsorptivity, the chlorine did not survive the regeneration steps. Due to the possibility and probability that fluorine in the adsorbent would be leached out if exposed to water, the fluorinated adsorbent should not be exposed to water. Thus, the two activity/performance enhancement steps of exposure of the adsorbent to water and fluorinating adsorbent cannot be practiced simultaneously, but are individually-effective alternatives. The amount of fluorine incorporated into the solid acidic adsorbent ranges from between about 1 to 5 weight percent, preferably between about 1 to 4 weight percent, most preferably between about 1 to 2 weight percent.

The solvent extracted oils are contacted with the solid acidic polar adsorbent at a temperature of between 25° C. to 250° C., preferably 50° C. to 200° C., most preferably 50° C. to 150° C. Contacting may be at a pressure in the range of 15 to 600 psig, preferably 50 to 400 psig. Contacting is also performed in an atmosphere of $N_2$, $H_2$, Group Zero noble gases (e.g., the inert gases, helium, argon, neon, etc.). $NH_3$-free hydrofiner off-gas and powerformer gas and mixtures thereof can also be used. The presence of a small amount of $H_2S$ in the treat gas had no adverse effect on the adsorbent performance for BNC removal.

Contacting with the solid acidic polar adsorbent may be under batch or continuous conditions, employing fixed or fluidized beds of adsorbent, under either concurrent or countercurrent flow conditions (as appropriate). The preferred mode of effecting the extracted oil/adsorbent contacting is passing a stream of liquid feed through a fixed bed of adsorbent. A two-bed system is desirable for a continuous production, with one bed adsorbing while the other is being regenerated.

Extracted oils are contacted with adsorbent for from 15 to 240 minutes, preferably 60 to 120 minutes. Expressed differently, the extracted oils are contacted with the adsorbent at a flow rate of 0.25 to 4 LHSV (v/v/hr), preferably 0.5 to 1.0 LHSV.

Adsorption pressure has little effect on liquid phase adsorption (see FIG. 7). In general, low LHSV or long residence time could produce a product having lower BNC. Also, the adsorption run length could be lengthened. However in a flow system total volume oil that can be processed per volume adsorbent is fixed by the adsorbent capacity for BNC removal.

Contacting is continued until the material exiting the contacting zone exhibits a BNC content approaching the BNC concentration of the feed entering the zone.

The spent adsorbent (i.e., BNC saturated adsorbent) is regenerated for re-use. This regeneration is accomplished by: (i) terminating oil feed flow to the adsorbent and substituting therefor a flow of hydrogen containing gas or inert gas to purge the adsorbent; and (ii) stripping off BNC from the adsorbent with hot hydrogen containing gas stream (ammonia free).

$H_2$-containing gaseous stream, i.e., pure $H_2$ and powerformer gas, can be used to purge and regenerate the spent adsorbent.

The purge gas flow is at a range of 50 to 1,000 GHSV, preferably 100 to 400 GHSV. This purge step is preferably conducted at the same pressure as that employed in the adsorption step since pressure is not critical during purge. Pressure during purge can be increased to 400 psig if a lower pressure is used in the adsorption operation. Temperature during this purge is held to between 25° C. to 250° C., preferably 50° C. to 150° C.

Temperature during this purge is about the same as used in the adsorption operation. High temperature purge, which could cause some desorption of basic nitrogen from the saturated adsorbent, is not desirable because any oil produced during the purge step can be blended with adsorbent treated oil as product.

The purge flow is conducted for a period of 4 to 16 hours, preferably 6 to 12 hours.

When the purging period is over and the adsorbent is relatively free of any entrained/retained oil the adsorber temperature was increased from the normal operating temperature to a temperature of between 300° C. and 500° C., preferably 350° C. to 450° C., at any convenient rate, a rate of 30° C. to 50° C. per hour being acceptable. During the heating period hydrogen flow rate and adsorber pressure are kept the same as that used in purging. Reference to FIG. 8 shows that higher regeneration temperatures are preferred as regeneration at higher temperatures results in an adsorbent which recovered more of its adsorbent capacity. A steady increase in temperature is preferred. A fast and uncontrolled increase in temperature is undesirable as it could affect the efficiency of adsorbent regeneration.

There appears to be no maximum flow rate of hydrogen during regeneration. It was found that decreasing the gas rate from 350 to 175 GHSV during regeneration slightly lowered the activity of the regenerated adsorbent for BNC removal. Thus, it appears that if a low purity $H_2$ is used for regeneration the gas flow rate should be increased accordingly.

The duration of high temperature regeneration is preferably from 24 to 36 hours. Depending on the amount of BNC adsorbed onto the adsorbent, a longer or shorter time can be used. In general, the regeneration is monitored by the concentration of $NH_3$ in the off-gas. When it falls to a very low level this is usually an indication that the regeneration is about complete.

Alternatively, the spent adsorbent can be regenerated by washing said spent adsorbent with a stream of the extraction solvent commonly used to extract the oil. This stream of extraction solvent, typically NMP, phenol, furfural, etc., preferably NMP, is contacted with the spent adsorbent at a temperature of from 25° C. to 200° C., preferably 50° C. to 150° C. This regeneration step employing a stream of extraction solvent as wash solvent is preferably performed after a hydrogen, nitrogen Group Zero noble gas or other inert gas purge under the conditions previously recited.

A flow system could be employed for adsorbent regeneration with extraction solvent, NMP. Conditions estimated for continuous wash are about 5–10 volume NMP per volume adsorbent and 0.5–1.0 LHSV can be used. Circulation of wash solvent through the adsorbent bed is the preferred operation because it would employ less solvent than a once-through mode.

According to the batch results shown in Table V it is estimated that about 5–10 volume NMP per volume adsorbent will be required. Contact time will be about 2–4 hours.

BNC's are stripped from the extraction solvent wash solution by evaporation of the extraction solvent. The regenerated adsorbent is stripped of any residual extraction solvent remaining in the adsorbent by use of a stripping gas, such as $N_2$, at temperatures between about 200° C. to 400° C., preferably 250° C. to 350° C.

The adsorbent regenerated by either of the procedures recited above exhibited essentially total recovery of adsorbent capacity for BNC's.

Another method for removing BNC from solvent extracted oil is to contact the oil with fuel cat cracker catalysts. Once the cracking catalyst is saturated with BNC the catalyst can be fed as make-up catalyst to a cat cracker unit and should function satisfactorily. Sending nitrogen-containing cracking catalyst, along with NMP extracted extract oil (which contains less BNC than phenol extract) to the cat cracker is not expected to put an extra load on the cat cracker operation since the total BNC in the slurry is about the same as that present in the current phenol extract oil. In this manner a separate adsorbent regeneration or disposal step can be avoided since the cracker catalyst used to adsorb the BNC can be employed (after saturation with BNC) as make-up catalyst, a use for which it was already intended.

The cracking catalyst saturated with BNC's need not be regenerated or treated in any way and is not a disposal problem. The BNC-saturated cracking catalyst can be fed directly to the cat cracker as make-up catalyst since it is usual for some catalyst to be lost as fines in cat crackers and this loss has to be replaced by make-up catalyst.

The BNC-saturated cracker catalyst can be fed to the cat cracker unit, either as such or diluted with extract oil. Dilution with extract oil is preferred since extract oil is presently typically fed to the cat cracker unit and its combination in the present invention with BNC-saturated cracker catalyst makes the BNC saturated cracker catalyst more easily to handle (as by pumping).

The BNC-saturated cracker catalyst can be separated from the raffinate oil with which it is contacted (so as to adsorb BNC therefrom) by settling and decantation, filtering or, preferably, by centrifuging in a centrifuge decanter. It is preferred that the BNC saturated cracker catalyst be as dry as possible so as to minimize the amount of oil lost through entrainment. Similarly, the recovered raffinate must be free of fines.

Decanting centrifuges achieve these ends and their performance is further enhanced and their use is even more desirable since the density difference between the oil (raffinate) and adsorbent is high.

In most adsorbent treating by frontal chromatography processes a static adsorbent bed is used. This results in less than desirable contact efficiency (mixing and back mixing). One of the features of this scheme is the use of on-line mixing (slurry processing) which has the high efficiency of adsorbent utilization. Following this by centrifugal separation allows for efficient liquid removal from the adsorbent and, hence, minimizes oil entrainment and yield losses. This also satisfies the need to keep the adsorbent mobile for transfer to the cat cracker.

The oil feeds which are solvent extracted can come from any natural or synthetic hydrocarbon source, but are preferably any natural petroleum or synthetic stream generally accepted as suitable lube or specialty oil feedstock. Such sticks include naphthenic or paraffinic petroleum stocks and those oils which are now derived from synthetic sources, such as tar sands, shale or coal.

These oil stocks are extracted by techniques common to the industry employing any of the typical extraction solvents, including phenol, furfural, $SO_2$, N-methylpyrrolidone (NMP), preferably NMP. NMP extracted oils, due to the lower acidity of the NMP extraction solvent (as compared to furfural extraction solvent) possess a higher concentration of basic nitrogen compounds and, thus, are most beneficially effected by a procedure designed to remove basic nitrogen compounds therefrom, i.e., procedures as herein described.

DESCRIPTION OF THE FIGURES

Referring to FIG. 4, distillate is fed via line (1) to an extraction treater tower (2) wherein it is countercurrently extracted with an extraction solvent (NMP) introduced to the tower via line (3). Extracted raffinate is recovered via line (4), while extract is recovered via line (5). Raffinate is fed via line (4) to stripper (6), wherein the extraction solvent is stripped from the raffinate oil. Recovered extraction solvent is recycled via lines (3A) and (3) back to the treater tower. Extract is fed via line (5) to a stripper (7), wherein the solvent is stripped from the extract using standard procedures, such as $N_2$ stripping, recycled via lines (3B) and (3) back to the treater tower. Extract is recovered via line (8) and sent for further processing/handling (not shown).

Figure 1:
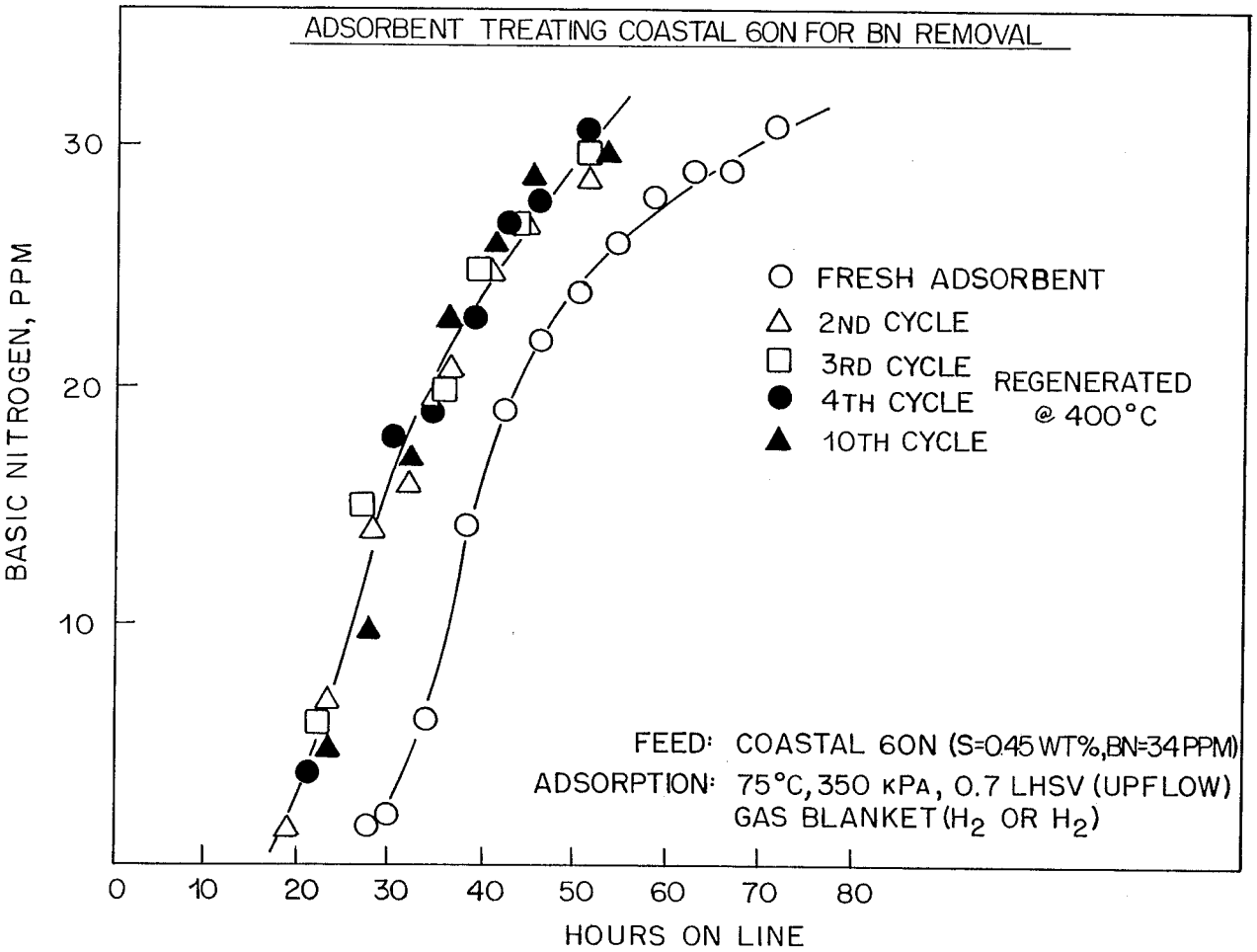
FIG. 1 presents the performance of fresh and regenerated adsorbent Ketjen high alumina base for BNC removal from NMP extracted transformer oil raffinate, which was derived from Coastal distillate.

Raffinate is recovered from stripper (6) via line (9) and sent to adsorber (10), wherein basic nitrogen compounds are adsorbed from the oil. Base stock substantially reduced in BNC is recovered via line (11). When the adsorbent in adsorber (10) is saturated with BNC raffinate, feed is cut-off to unit (10) via valve (9A). Extraction solvent is fed to adsorber (10) via line (12), valve (12A), previously closed, now being open to permit such flow. The BNC's are stripped from the adsorbent and the extraction solvent bearing BNC's from unit (10) is fed via line (13) to line (5) for introduction to the extract stripper, wherein the extraction solvent is freed from the BNC's and the purified extraction solvent is recovered via line (3B) for recycle in the system.

EXPERIMENTAL

Adsorbent

A number of adsorbents were evaluated in a batch system for their effectiveness in removing BNC from lube oils. Results shown in Table I indicated that silica-alumina type adsorbents, Ketjen high alumina base (amorphous) and H-Y zeolite (crystalline) are more effective than either alumina or silica for basic nitrogen removal. Ketjen base was further compared with H-Y zeolite for removing BNC from NMP extracted raffinate oil. Results shown in Table II indicate that the former is the preferred adsorbent.

The preferred Ketjen high alumina base has a silica/alumina weight ratio of about 3. H-Y zeolite has a silica/alumina weight ratio of 2–3 and pore diameter of about 10 Å (total alumina present, all forms, about 18 weight percent). Davison RC-25 consists of small pore zeolite (3 Å) and about 20 weight percent amorphous silica/alumina and other clays (total alumina present, all forms, is about 28 weight percent).

TABLE I

ADSORBENTS FOR BASIC NITROGEN REMOVAL

| Adsorbent | Activated Alumina | Attapulgas Clay | Activated Carbon | Silica Gel | Cat Cracking Catalyst (Division RC25) | HY Zeolite | Ketjen HA Base |
|---|---|---|---|---|---|---|---|
| Surface Area, $m^2/g$ | 245 | — | 800 | 500 | — | — | 380 |
| % BNC Removal | 12 | 36 | 64 | 75 | 90 | 99 | >99 |
| % S Removal | — | — | — | — | — | 9 | 4 |

Batch Treating Conditions: Oil/Adsorbent Weight Ratio - 3.3/1, 250° C., 2 hours.
Feed: Distillate (S = 0.45 Wt. %, BN = 240 ppm).
Unextracted 150N distillate derived from Western Canadian Crude. The distillate, after dewaxing, has a −12° C. pour and a VI of 67.

TABLE II

BATCH ADSORBENT TREATING EXTRACTED LUBE OIL FOR BASIC NITROGEN REMOVAL

| Adsorbent | H-Y Zeolite | | | Ketjen HA Base | | |
|---|---|---|---|---|---|---|
| Treating Temperature, °C.(1) | 100 | 150 | 250 | 100 | 150 | 250 |
| % BNC Removal | 18 | 53 | 92 | >98 | >98 | >98 |

Feed: Western Canadian 150N stock, NMP extracted (90 VI, 0.17 Wt. % sulfur, 51 ppm BN).
(1)Other conditions: Oil/Adsorbent Weight Ratio = 20/1, 2 hours. The feed used here is NMP extracted oil.

Lab studies have shown that the capacity of amorphous silica/alumina for basic nitrogen removal increases with increasing alumina content (Table IIA).

TABLE IIA

Adsorbent Composition Can Affect its Capacity for BN Removal

| Adsorbent | Ketjen HA Base | Ketjen LA Base |
|---|---|---|
| Composition, Wt. % | | |
| $Al_2O_3$ | 24.4 | 15.2 |
| $SiO_2$ | Balance | Balance |
| % Basic Nitrogen Removal | 95 | 40 |

Feed: 101 VI NMP extracted dewaxed raffinate derived from North Sea Crude (42 ppm basic nitrogen)
Batch Treating Conditions: 100° C., oil adsorbent weight ratio = 40/1, 2 hours These results, along with our previous data on silica gel, Ketjen HA and activated alumina (Table I), suggest that 20–30 weight percent alumina, preferably about 20–25 weight percent alumina is the desired composition for basic nitrogen removal. This value seems consistent with literature data (J. of Catalysis 2 16–20, 1963) which show the highest activity of silica/alumina for many reactions including mobility of adsorbed ammonia to be between 15% and 30% alumina.

Pilot Plant Adsorption Studies

Figure 2:
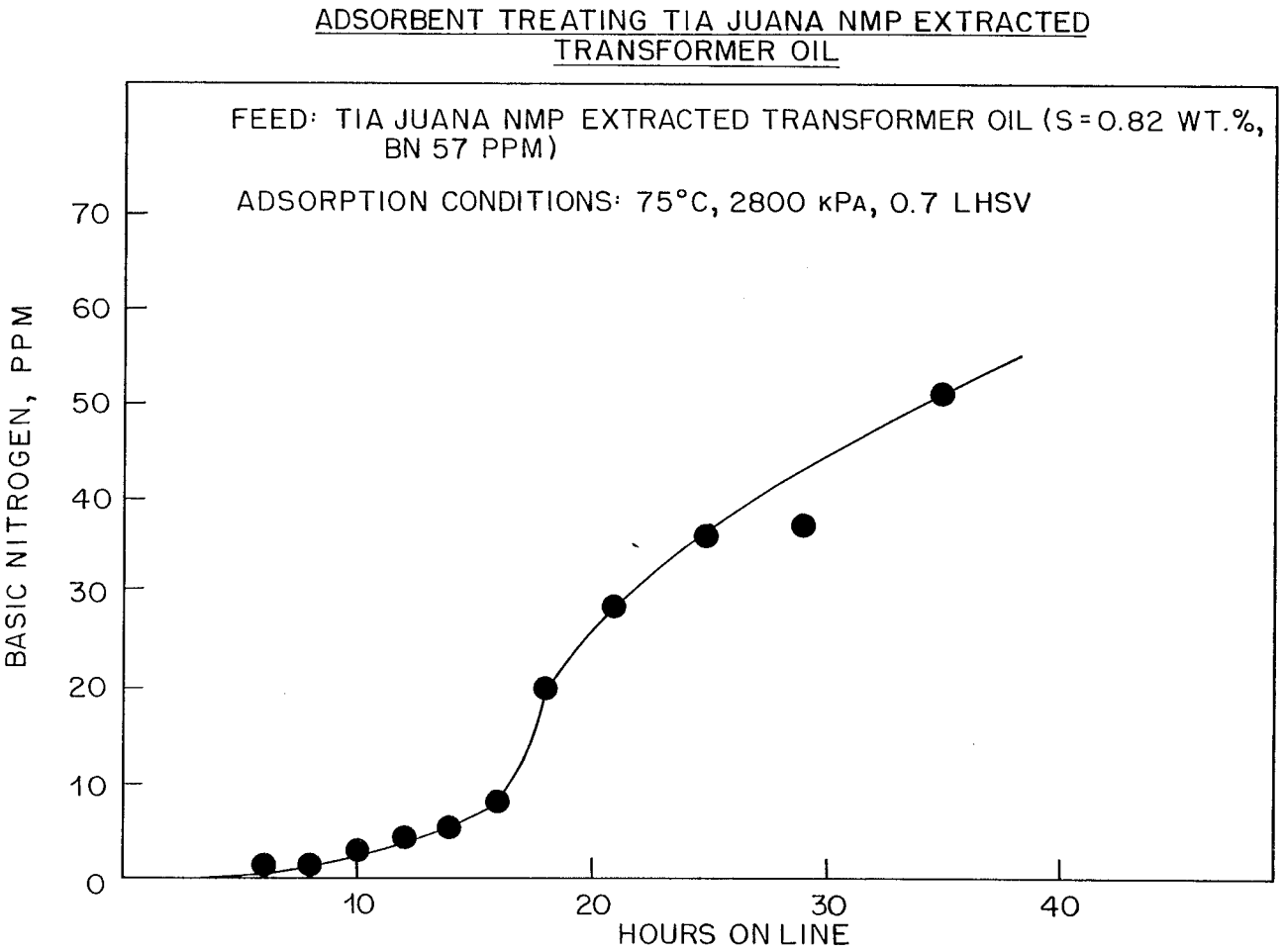
FIG. 2 presents performance of Ketjen high alumina base for BNC removal from Tia Juana NMP extracted oil as a function of time.
Figure 3:
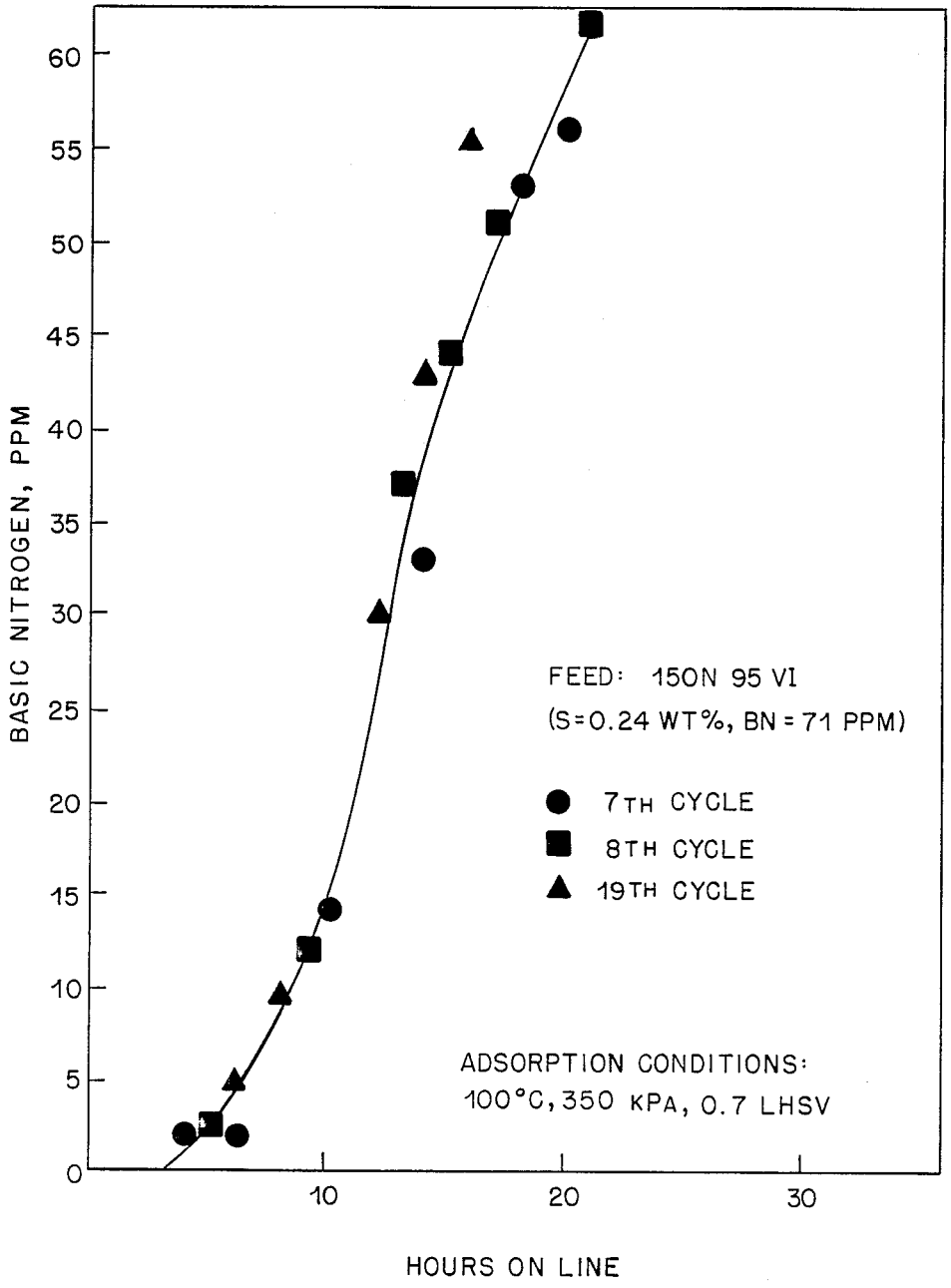
FIG. 3 presents performance of Ketjen high aluminum base for BNC removal from North Sea NMP extracted 150N 95 VI oil as a function of time.
Figure 4:
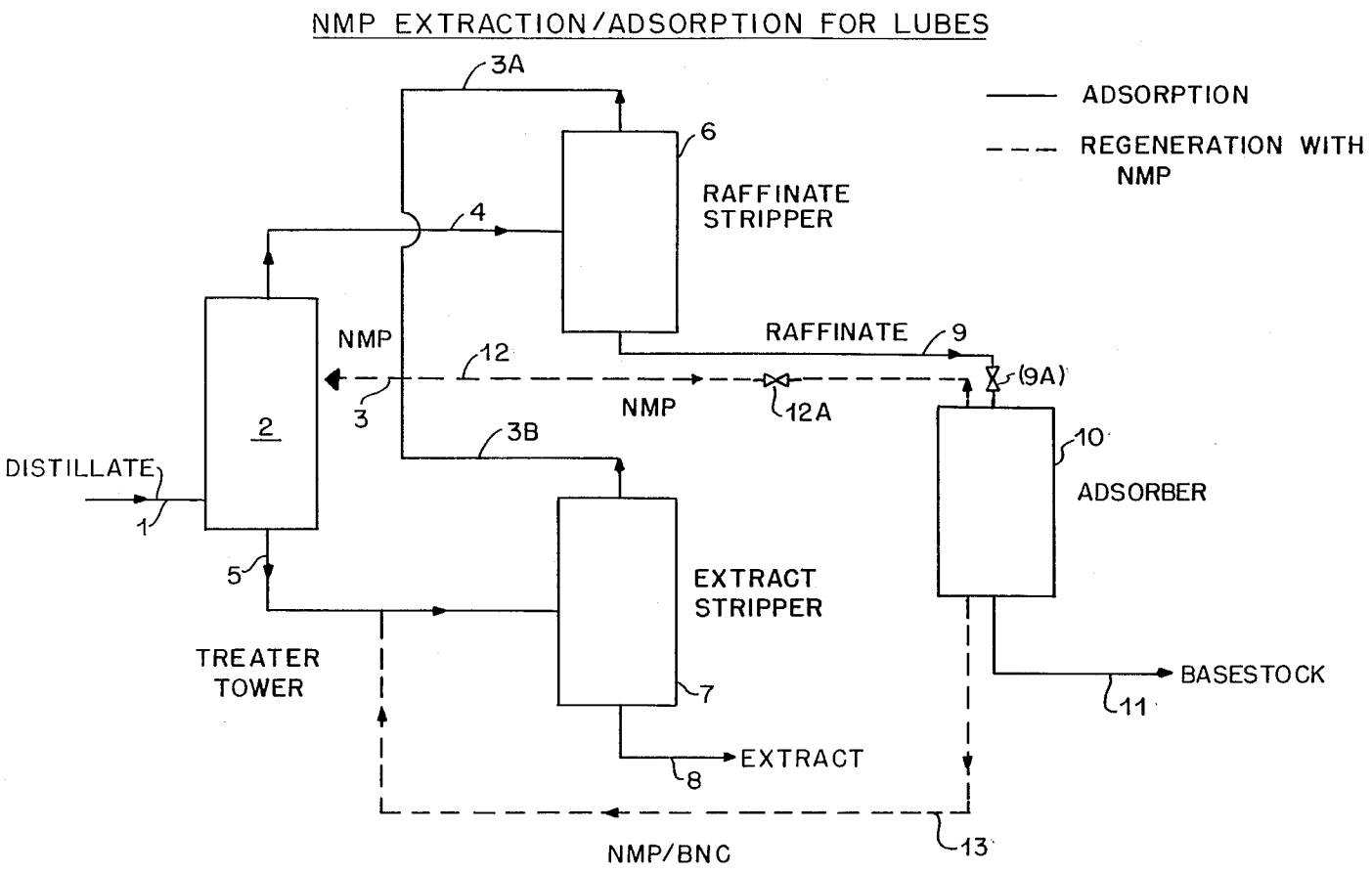
FIG. 4 presents a schematic (omitting standard operating equipment, such as pumps, valves, meters, etc., the location and operation of which are known to operators skilled in the art or whose location would be a matter of choice on a case-by-case basis) of an integrated NMP extraction/adsorption/regeneration process.

Ketjen high-alumina base, an acidic, wide pore adsorbent, was evaluated in the pilot plant using a flow system. Adsorption was carried out by passing the NMP extracted raffinate oil in a continuous flow over a fixed bed of adsorbent at 70° C. to 100° C., 350 kPa and 0.7 LHSV with a small flow of $N_2$ or $H_2$ as blanket. The NMP extracted transformer oil raffinates, Coastal and Tia Juana 60N, and a North Sea 150N 95 VI oil were used as feedstocks. Samples taken during the run were inspected for basic nitrogen and sulphur. Plots of basic nitrogen versus hours on-stream are shown in FIGS. 1-2-3. The results indicated that basic nitrogen removal decreased with increasing adsorbent age (as expected), but sulphur removal was negligible during the entire run.

Regeneration Studies

Adsorbent regeneration, a critical part of a successful adsorption process, was also determined in pilot plant studies. When product basic nitrogen approached that of the incoming feed the oil feed was shut off and $H_2$ flow rate was increased to 380 GHSV to purge the adsorbent bed for 6 hours and rector pressure was increased to 2.8 MPa. Temperature was kept at that of the adsorption runs. Following purge, adsorber temperature was then increased at a rate of 50° C./hour to 400° C. These conditions were held for 24 hours. At the end of the regeneration period adsorber conditions were re-established for the next cycle adsorption. The performance of the regenerated adsorbent for removing BNC from Coastal transformer oil and North Sea 150N 95 VI oil is shown in FIGS. 1 and 3, respectively. Results indicated that after the first regeneration adsorbent performance for basic nitrogen removal was essentially restorable with $H_2$ stripping at 400° C.

Basestock Quality

Spot samples produced in the adsorption run were blended to make product for quality testing. Inspections of product and the oxidation stability results are shown in Tables III and IV for Coastal transformer oil and North Sea 150N oil, respectively. The results indicated that the adsorbent treated oil exhibited a much better oxidation stability than the conventionally hydrofined oil.

TABLE III

OXIDATION STABILITY OF COASTAL NMP EXTRACTED TRANSFORMER OIL BASESTOCK

| | Conventional H/F Cyanamid HDN-30 Catalyst | Ketjen HA Base Adsorbent Treated |
|---|---|---|
| Sulfur, Wt. % | 0.13 | 0.44 |
| Basic Nitrogen, ppm | 23 | 5 |
| ASTM D2440, 164 hours test (Inhibited With 0.05 Wt. % DBPC) | | |
| Volatile Acid, mg KOH/g | 0.76 | 0.53 |
| Soluble Acid, mg KOH/g | 0.72 | 0.25 |
| Sludge, Wt. % | 0.29 | 0.13 |
| Total Oxidation | 0.76 | 0.38 |
| Conventional H/F Conditions Employed: 300° C., 1.0 LHSV, 340 psig $H_2$ | | |

TABLE IV

OXIDATION STABILITY OF 150N, 95 VI DEWAXED OILS

| | Conventional H/F Cyanamid HDN-30 Catalyst) | Ketjen HA Base Adsorbent Treated |
|---|---|---|
| Sulphur, Wt. % | 0.17 | 0.23 |
| Basic Nitrogen, ppm | 70 | 35 |
| Initial Index | 14 | 19 |
| IP, 306 Total Oxidation Products | 2.1 | 0.9 |
| Nuto 32 Formulation | | |
| Staeger, hours 0.2 TAN | 350 | 480 |
| RBOT Life, minutes | 273 | 333 |
| D943 Life, hours | 780 | 1350 |

Conventional H/F Conditions: 300° C., 1.0 LHSV, 340 psig $H_2$.

Regeneration Using Extraction Solvent

The operability of regenerating adsorbent with NMP was demonstrated in lab batch studies (Table V). A 150N 95 VI raffinate (71 ppm BN) was treated with Ketjen high alumina base at 80° C. for 2 hours. After filtration the saturated adsorbent was washed with NMP at 80° C. for one hour. The mixture was then filtered and NMP was evaporated from the filtrate. Measurement on the basic nitrogen content of the residual oil desorbed from the adsorbent indicated that NMP washing essentially removed all basic nitrogen compounds from the adsorbent. The performance of the NMP-regenerated adsorbent after drying with $N_2$ at 300° C. was found essentially restored.

TABLE V

| REGENERATING ADSORBENT WITH NMP | Fresh Adsorbent | Regenerated Adsorbent |
|---|---|---|
| Adsorption[1] | | (3) |
| Basic Nitrogen in Feed, ppm | 71 | 71 |
| Basic Nitrogen in Product, ppm | 34 | 35 |
| Basic Nitrogen Adsorbed, mg/g adsorbent | 0.370 | |
| Regeneration[2] | | |
| Basic Nitrogen in Desorbate, ppm | 474 | |
| Amount of Oil Desorbed, gm | 11.5 | |
| Basic Nitrogen Desorbed, mg/g adsorbent | 0.368 | |

[1]Weight ratio of North Sea 150N, 95 VI/Ketjen base = 10/1 Temperature = 80° C.
[2]Weight ratio of NMP/adsorbent = 5/1 Temperature = 80° C.
[3]After nitrogen stripping at 300° C.

Separation of BNC Using Cat Cracking Catalyst

Table VI shows the performance of typical cat cracking catalyst for the removal of BNC from typical raffinates.

It is important to mention that because cat cracking catalysts are molecular sieve types they are diffusion limited. To obtain acceptable capacity the temperature of adsorption was raised up to about 200° C.

It is also worthwhile to mention that the capacity of the cat cracking catalyst is much less than that claimed for other described adsorbent. However, the use of cat cracking catalyst permits one to avoid adsorbent regeneration.

The cat cracking catalyst employed in the Example was Davison RC-25, which has the following characteristics:

Physical Properties

Surface Area: 190 $m^2$/gm
Packing Volume: 0.22 cc/gm
Packing Density: 0.73 gm/cc

Composition (Wt. %)

$SiO_2$: 70
$Al_2O_3$: 28
Na: 0.54
Fe: 0.48

Activity (Micro-Reactor Test)

80% conversion after 1,400° F. steam treated for 6 hours at 5 psi (the feed was West Texas VGO).

TABLE VI

| PERFORMANCE OF CAT CRACKING CATALYST FOR BNC REMOVAL | | | | |
|---|---|---|---|---|
| Temperature °C. | | 75 | 200 | 200 |
| Oil/Adsorbent Weight Ratio | | 6/1 | 6/1 | 20/1 |
| % BNC Removal | 0 | 59 | 98 | 64 |
| % S Removal | 0 | — | <1 | <1 |

Figure 5:
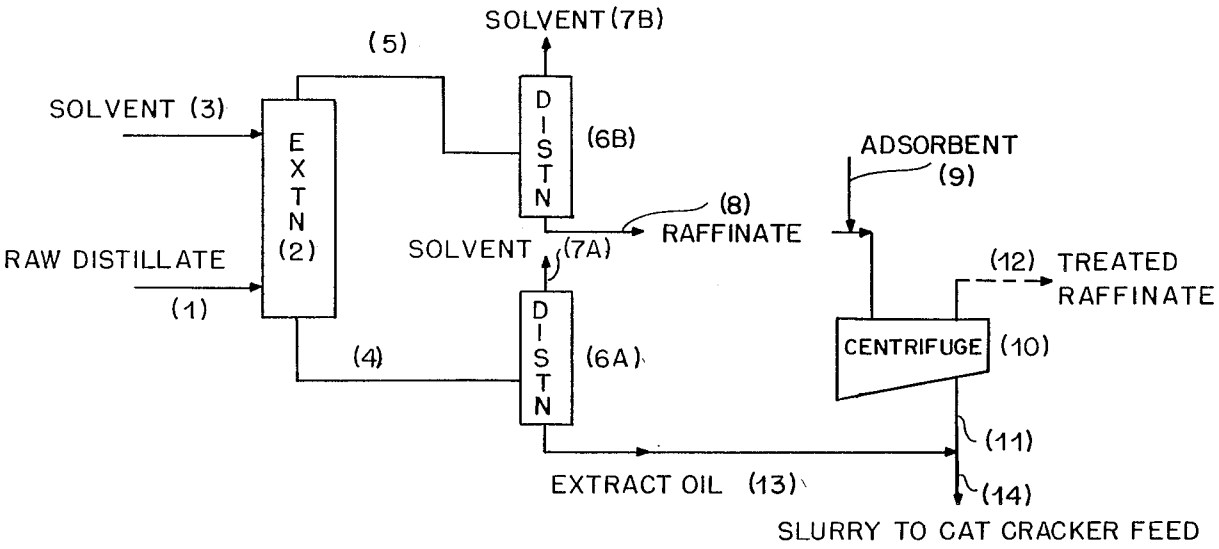
FIG. 5 is a schematic of an integrated solvent extraction-BNC adsorption process using a cat cracker catalyst as adsorbent and BNC saturated cracker catalysts make-up catalyst.

(1) Feed: Tia Juana 102 NMP extracted transformer oil raffinate
S = 0.82 Wt. %
BN = 57 ppm FIG. 5 is a schematic of the process wherein raw distillate to be solvent extracted is fed via line (1) into extraction zone (2) wherein it is combined with extraction solvent feed into zone (2) via line (3). Extract is recovered from zone (2) via line (4). This recovered extract is fed via line 4 to solvent stripper (6A) wherein solvent is recovered via line (7A) for recycle. Solvent free extract is recovered via line (13).

Raffinate is recovered from zone (2) via line (5). This raffinate is fed into solvent stripper (6B) wherein solvent is separated from the raffinate and recovered via line (7B) for recycle. Solvent free raffinate is recovered via line (8). While in line (8) it is contacted with adsorbent [fresh cracker catalyst introduced into line (8) via line (9)]. The cracker catalyst (containing adsorbed BNC) is separated from the raffinate in centrifuge decanter (10). Dry BNC saturated cracker catalyst is recovered from centrifuge (10) via line (11). Treated raffinate product is recovered from centrifuge (10) via line (12). The BNC saturated cracker catalyst via line (11) is combined with solvent free extract from line (13) and the combined extract-BNC saturated cracker catalyst slurry is fed via line (14) to the cat cracker.

Figure 6:
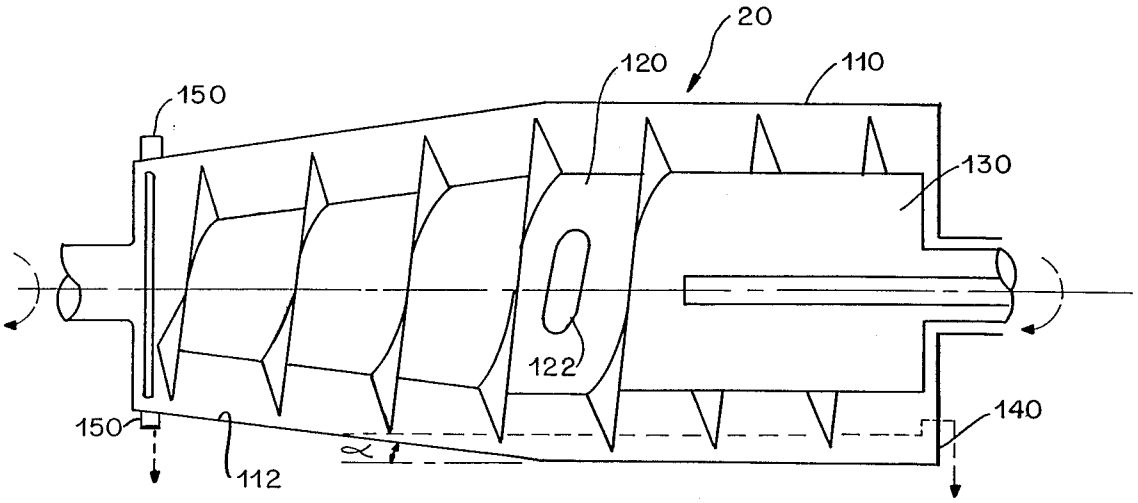
FIG. 6 is a simplified schematic of a preferred decanter centrifuge.
Figure 7:
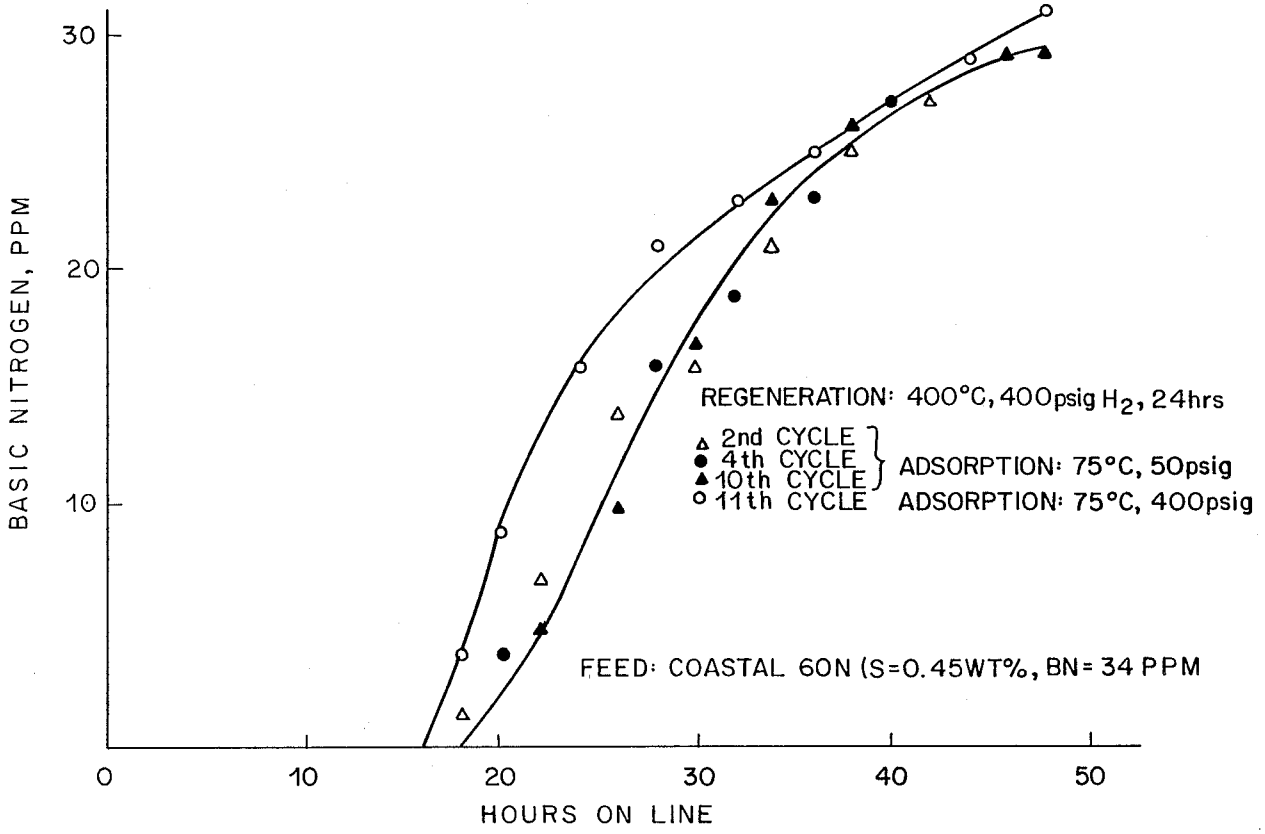
FIG. 7 shows the effect of adsorption pressure on adsorbent performance for BNC removal to be insignificant.
Figure 8:
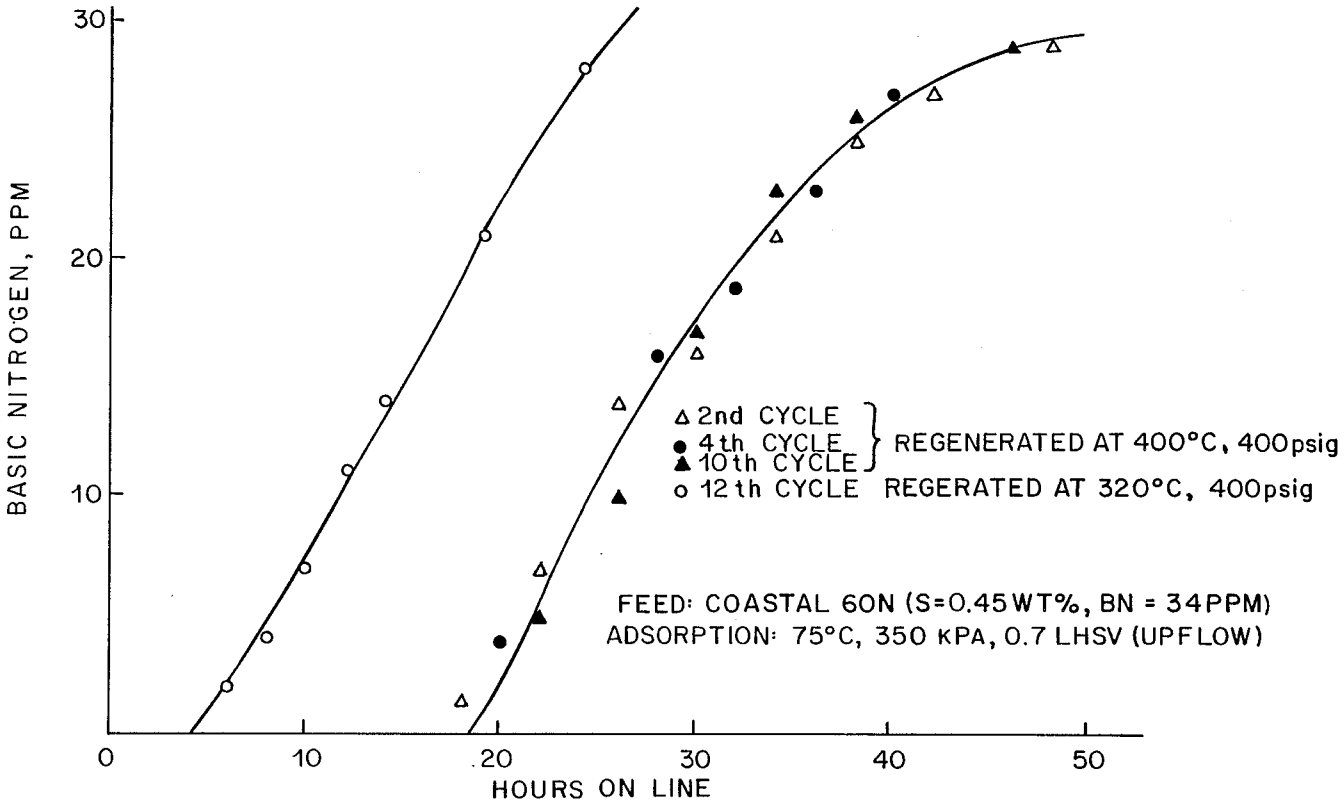
FIG. 8 shows regeneration temperature ($H_2$ stripping) is critical.

Referring to FIG. 6, a simplified schematic drawing is shown on a Sharples Model P850 vertical scroll decanter centrifuge (20), often also referred to as a solid-bowl centrifuge, 150 mm in diameter and 350 mm in length. A vertical cylinder rotor bowl (110), driven by a motor and gear means (not shown) contains a helical screw conveyor (120), rotating in the same or opposite direction to the bowl but at a different speed, which is affixed to hollow shaft (130). Feed is introduced through shaft (130) and discharged into bowl (110) through opening (122), typically located near the end of the cylindrical section of bowl (110). The slurry feed discharged is forced to travel around the helical screw conveyor (102) by centrifugal force, causing the fines and liquid to separate. The fines deposit on the interior wall of bowl (110), while the liquid forms an inner ring, with the thickness of the ring determined by the height of overflow weir (140). As the liquid travels around helical screw conveyor (120) the liquid becomes clearer as it approaches overflow weir (140). Liquid, substantially free of entrained BNC saturated catalyst fines, passes over weir (140) for recovery as product oil. The catalyst layer is forced to travel in a direction opposite to that of the liquid by the difference in rotary speed between rotating bowl (110) and screw conveyor (120). The speed of catalyst discharged is directly proportional to the relative velocity of bowl (110) and screw conveyor (120). When bowl (110) and screw conveyor (120) are rotating in the same direction bowl (110) typically rotates at a higher speed than screw conveyor (120). Thus, faster rotation of screw conveyor (120) in the same direction as the rotation of bowl (110) usually reduces the relative velocity between the bowl and the screw conveyor, thereby decreasing the rate of catalyst movement through centrifuge (20). The catalyst travels along the conical beach section (112) for further drying prior to discharge through ports (150) and eventual feeding as make-up catalyst to the cracker unit.

Methods of Further Improving Adsorbent Performance for BNC Removal

(1) Pre-hydrofining NMP Extracted Raffinate

Figure 9:
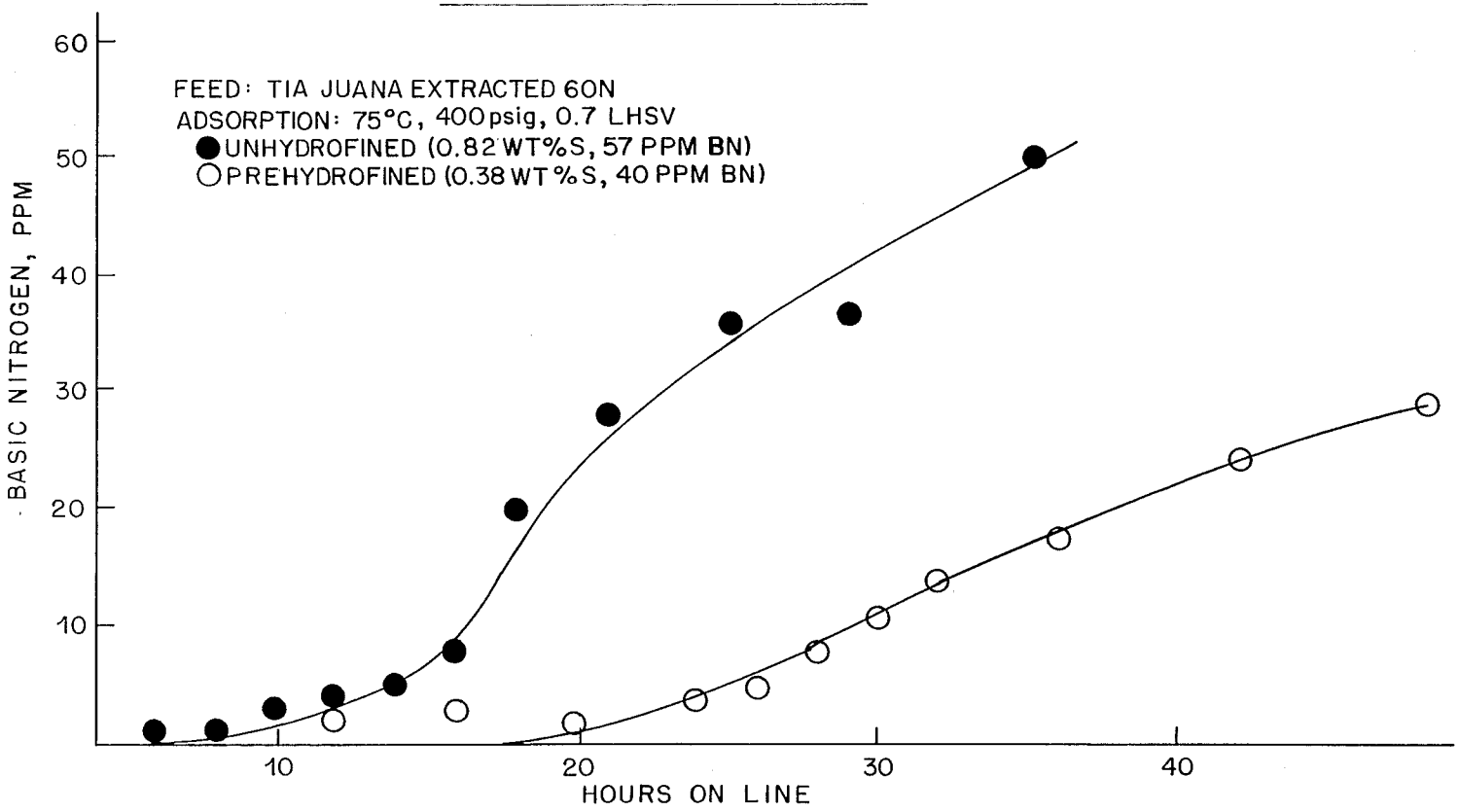
FIG. 9 shows the effect of pre-hydrofining on the performance of BNC removal (Ketjen HA used as adsorbent).

The beneficial effect of pre-hydrofining on adsorbent treating in terms of basic nitrogen removal is shown in FIG. 9. NMP extracted Tia Juana 60N raffinate (S=0.82 weight percent, BN=57 ppm) was hydrofined over a Ni/Mo catalyst (Cyanamid HDN-30) at 300° C., 4.1 MPa $H_2$, 1.5 LHSV and 2.5K mol/$m^3$ gas rate to produce a feedstock (S=0.38 weight percent, 40 ppm BN) for adsorbent treating using Ketjen HA as adsorbent.

Results indicated that pre-hydrofining increased the adsorbent capacity.

The pre-hydrofining conditions are quite similar to those used in conventional hydrofinishing, i.e., 200°-350° C., preferably 200°-300° C.; about 2-6 MPa, preferably about 3-5 MPa $H_2$ pressure; about 0.5-4 LHSV, preferably 0.5-2 LHSV; and about 1-10 K mol/m$^3$, preferably about 1.5-5.0K mol/m$^3$ gas rate and utilize typical hydrocarbon catalysts, i.e., mixed Group VB and Group VIII metals, their oxides and sulfides, and mixtures thereof, on a refractory metal oxide support, such as alumina catalysts of the type Ni/Mo on alumina and Co/Mo on alumina are representative of typical catalysts. The optimum hydrofining conditions as left to the practitioner to be determined by the extent of hydrodesulfurization required for the process.

(2) Incorporating Fluorine Into HA Adsorbent

In our laboratory studies we have found that adsorbent capacity for BN can be significantly increased by treatment with anhydrous HCl (3-5% HCl was incorporated in the Ketjen HA).

Ketjen HA was first calcined at 400° C. for 2 hours and then allowed to cool to ambient temperature. The calcined Ketjen HA was used as a base case adsorbent in comparison studies. A flow of anhydrous HCl gas was passed through the calcined adsorbent bed to incorporate HCl into adsorbent. The HCl-loaded adsorbent was tested for basic nitrogen removal. In a separate study, a sample of some HCl-loaded adsorbent was purged with argon gas at 400° C. to simulate an adsorbent regeneration. The argon stripped adsorbent was then evaluated for basic nitrogen removal. Chlorine-containing adsorbents, before and after argon stripping, were analyzed for chlorine content. Results shown below (Table VII) indicated that Ketjen HA capacity for basic nitrogen can be significantly increased by incorporating 3 weight percent chlorine into the adsorbent during the HCl-pretreatment step. However, after purging with argon at 400° C. for 2 hours, chlorine was readily depleted from the adsorbent. As a result, the adsorbent capacity for basic nitrogen dropped to the original level (pre-HCl treatment).

TABLE VII

PERFORMANCE OF HCl TREATED KETJEN HA FOR BASIC NITROGEN REMOVAL

| | Feed | (1) | (2) | (3) |
|---|---|---|---|---|
| Chlorine, Wt. % (x-ray) | — | 0 | 3.0 | 0.25 |
| Basic Nitrogen, ppm | 82 | 34 | 7 | 32 |
| % Basic Nitrogen Removal | — | 58.5 | 91.5 | 60.9 |

(1) North Sea 95 VI NMP extracted raffinate oil. Adsorption conditions: 100° C. for 2 hours oil/adsorbent weight ratio: 40/1.
(2) Ketjen HA pretreated with anhydrous HCl gas.
(3) HCl-loaded adsorbent purged with argon gas at 400° C. for 2 hours.

Quite surprisingly, however, we have found that by impregnating Ketjen HA with $NH_4F$ solution, drying at 100° C. and calcined at 400° C. and 500° C. in air for 2 hours, 1-2 weight percent fluorine was incorporated into the adsorbent, the fluorine containing adsorbent has higher capacity than fluorine-free adsorbent (Table VIII). In view of this stability it is presumed that the fluorine loaded adsorbent can be regenerated.

Samples of Ketjen HA base were mixed with $NH_4F$ aqueous solution to give different fluorine strength on adsorbent. These materials were mixed and then evaporated with a rotavaporator at about 50° C. at 30 mmHg for 6 hours to remove excess water from the wet adsorbent. Then it was dried in an oven at 100° C. for 16 hours. The dried adsorbent was then calcined at 400° C. and 500° C. in air for 2 hours.

In general, drying temperatures may range from about 50° C. to 150° C. A two-hour calcination at 400° C. appears to be adequate, but higher calcination temperatures did not affect the adsorbent performance. Atmospheres other than air can be used. Fluorine sources other than $NH_4F$, i.e., aqueous HF, could be used for fluorination.

TABLE VIII

ADDITION OF FLUORINE ONTO KETJEN HA IMPROVED ADSORBENT PERFORMANCE FOR BN REMOVAL

| | Feed(1) | | | | | |
|---|---|---|---|---|---|---|
| Wt. % Fluorine(2) | 0 | | 1 | | 2 | |
| Calcination Temp, °C.(3) | — | — | 400 | 500 | 400 | 500 |
| Basic Nitrogen, ppm | 82 | 34 | 24 | 22 | 22 | 21 |
| % BN Removal | — | 58.5 | 70.7 | 73.2 | 73.2 | 74.4 |

(1)North Sea 95 VI NM extracted raffinate oil. Adsorption conditions = 100° C. for 2 hours. Oil/adsorbent weight ratio = 40/1.
(2)Fluoride adsorbents were made by impregnating Ketjen HA with different concentrations of $NH_4F$ solution, calcined at 400° C. and 500° C. The fluorine-containing adsorbents were stable at 400° C. and 500° C. in air.
(3)After drying the $NH_4F$ impregnated Ketjen HA.

Water Loading Adsorbent

It has been found that pretreatment of Ketjen HA with $H_2O$ is beneficial to basic nitrogen adsorption.

Samples of wet Ketjen HA base were prepared by either treating the calcined adsorbent (the base case no fluorine loading) with wet nitrogen purge or by first soaking with distilled water, then adjusting final water level by filtration and drying. The amount of water added to the calcined adsorbent was measured by the increase in weight. The calcined and water pretreated adsorbents were ground to a powder and slurry mixed with a North Sea 150N dewaxed NMP raffinate to test the effect of water content on adsorption performance.

TABLE IX

PRETREATMENT OF KETJEN HA WITH WATER IMPROVED ADSORBENT PERFORMANCE FOR BASIC NITROGEN REMOVAL

| Wt. % Water | Feed(1) | Base Case(2) | 9 | 14 | 22 | 25 | 30 | 43 | 51 |
|---|---|---|---|---|---|---|---|---|---|
| BN, ppm | 56 | 15 | 14 | 10 | 7 | 5 | 3 | 44 | 54 |

(1) Feed: 150N 101 VI NMP extracted dewaxed raffinate derived from North Sea Crude
(2) Calcined at 400° C. Batch Treating Conditions: 75° C., oil/adsorbent (dry basis) weight ratio = 40/1

Results (Table IX) indicate that the capacity of Ketjen HA for basic nitrogen removal increases with increasing water contents up to approximately 30 weight percent. After that the adsorbent capacity declines rapidly.

It is not known precisely why pretreating the Ketjen HA with water serves to increase its performance for basic nitrogen removal. While not wishing to be bound by theory, it may be postulated that hydration could change some Lewis sites into Bronsted sites. The latter has a higher capacity for basic nitrogen that the former.

What is claimed is:

1. A method for improving the oxidation stability of solvent extracted oils by contacting said solvent extracted oil with a solid polar acidic adsorbent containing between 20 to 30 weight percent alumina, said adsorbent having a surface area of from 50 to 700 $m^2/g$ and an average pore diameter of from 10 to 200 Å.

2. The method of claim 1 wherein the solid acidic adsorbent contains up to about 30 weight percent water.

3. The method of claim 1 wherein the solid acidic adsorbent has been pretreated with a fluorinating agent to incorporate about 1 to 5 weight percent fluorine into the adsorbent.

4. The method of claim 1, 2 or 3 wherein the solvent extracted oil is contacted with the adsorbent at a temperature between about 25° C. to 250° C. and at a pressure of between about 15 to 600 psig.

5. The method of claim 1, 2 or 3 wherein the solvent extracted oil is contacted with the adsorbent in an atmosphere of $N_2$, $H_2$, Group Zero noble gases, ammonia free hydrofiner off-gas, powerformer gas and mixtures thereof.

6. The method of claim 4 wherein the solvent extracted oil is contacted with the adsorbent in an atmosphere of $N_2$, $H_2$, Group Zero noble gases, ammonia free hydrofiner off-gas, powerformer gas and mixtures thereof.

7. The method of claim 1, 2 or 3 further including the regeneration of saturated adsorbent by purging the adsorbent with hydrogen and stripping the saturated adsorbent with a hot hydrogen containing gas stream.

8. The method of claim 4 further including the regeneration of saturated adsorbent by purging the adsorbent with hydrogen and stripping the saturated adsorbent with a hot hydrogen containing gas stream.

9. The method of claim 7 wherein the purging is conducted at a purge gas flow rate of about 50 to about 1000 GHSV and at a temperature of about 25° C. to 250° C.

10. The method of claim 8 wherein the purging is conducted at a purge gas flow rate of about 50 to 1000 GHSV and at a temperature of about 25° C. to 250° C.

11. The method of claim 9 wherein the stripping of the adsorbent with hot hydrogen containing gas stream is conducted at a temperature between about 300° C. to 500° C.

12. The method of claim 10 wherein the stripping of the adsorbent with hot hydrogen containing gas stream is conducted at a temperature between about 300° C. to 500° C.

13. The method of claim 1, 2 or 3 including the regeneration of the saturated adsorbent by washing the adsorbent with extraction solvent.

14. The method of claim 13 wherein the regenerative washing step is preceded by a purge step employing hydrogen, nitrogen, Group Zero noble gas or inert gas at a purge gas flow rate of about 50 to 1000 GHSV and at a temperature of about 25° C. to 250° C.

15. The method of claim 13 wherein the extraction solvent used to wash the spent adsorbent is NMP, phenol, furfural.

16. The method of claim 13 wherein the washing step is conducted at a temperature of from 25° C. to 200° C.

17. The method of claim 1, 2 or 3 wherein the solvent extracted oil is subjected to a hydrofining step prior to being contacted with the adsorbent.

18. The method of claim 17 wherein the hydrofining is performed over a Group VB-Group VIII metal, oxide, sulfide and mixtures thereof on refractory metal oxide support catalyst at a temperature between about 200° to 350° C., a pressure of about 2–6 MPa $H_2$, about 0.5–4 LHSV and about 1–10K mol/$m^3$ gas rate.

* * * * *